US005949382A

United States Patent [19]

Quan

[11] Patent Number: 5,949,382

[45] Date of Patent: Sep. 7, 1999

[54] DIELECTRIC FLARE NOTCH RADIATOR WITH SEPARATE TRANSMIT AND RECEIVE PORTS

[75] Inventor: Clifton Quan, Arcadia, Calif.

[73] Assignee: Raytheon Company, Lexington, Mass.

[21] Appl. No.: 08/246,538

[22] Filed: May 20, 1994

Related U.S. Application Data

[63] Continuation of application No. 07/589,965, Sep. 28, 1990, abandoned.

[51] Int. Cl.[6] ..... H01Q 1/38

[52] U.S. Cl. ..... 343/767

[58] Field of Search ..... 343/767, 770, 343/795; H01Q 13/08, 1/38

[56] References Cited

U.S. PATENT DOCUMENTS

| | | | |
|---|---|---|---|
| 4,500,887 | 2/1985 | Nester | 343/795 |
| 4,509,055 | 4/1985 | Fassett | 343/754 |
| 4,782,346 | 11/1988 | Sharma | 343/795 |
| 4,918,409 | 4/1990 | Lamberty | 333/1.1 |

OTHER PUBLICATIONS

"Broadband Antenna Study," L.R. Lewis et al., Final Report AFCRL–TR–75–0178, Air Force Cambridge Research Laboratories, Mar. 1975.

"Analysis of the Tapered Slot Antenna," Janaswamy et al., IEEE Trans. Antennas and Propagation, vol. AP–35, No. 9, Sep. 1987, pp. 1058–1059.

"The Vivaldi Aerial," P.J. Gibson, Proceedings of the Ninth European Microwave Conference, 1979, at pp. 101–105.

"Improved design of the Vivaldi antenna," E. Gazit, IEE Proc., vol. 135, Pt.H, No. 2, Apr. 1988, at pp. 89–92.

"A New Model for Broadband Waveguide–to–Microstrip Transition Design," Ponchak et al. Microwave Journal, May, 1988, pp. 333 et seq.

*Primary Examiner*—Michael C. Wimer

*Attorney, Agent, or Firm*—Leonard A. Alkov; Glenn H. Lenzen, Jr.

[57] ABSTRACT

A dielectric antipodal flared notch radiator with separate transmit and receive ports for phased array and active array antennas. A circulator is integrated directly to the broadside coupled-strip transmission line portions of the antipodal flared notch radiator without the use of baluns. The look-in impedance of the radiator element is improved as a result of the circulator and lack of a balun. By sandwiching the antipodal flared notch between two additional layers of dielectric, the device can be made a building block for broadband active array antennas.

8 Claims, 3 Drawing Sheets

Fig. 4
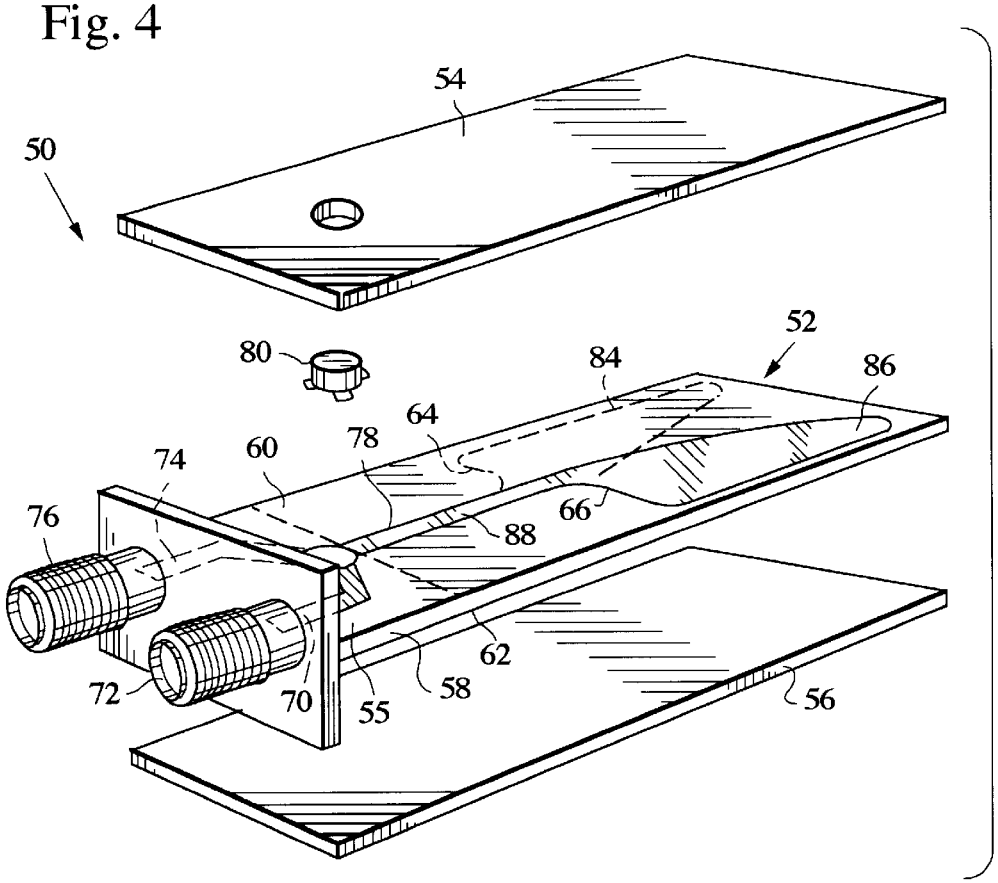
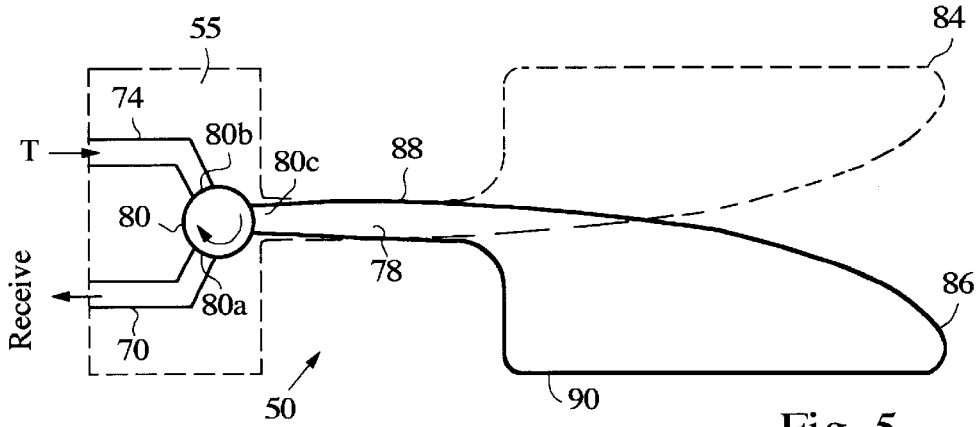
Fig. 5
Fig. 6
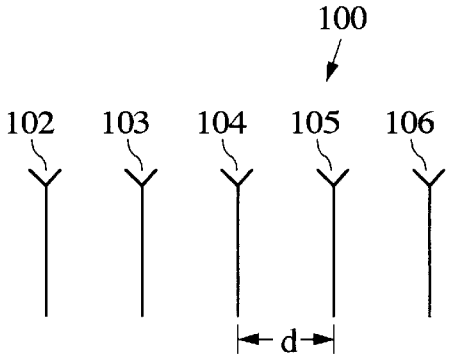

DIELECTRIC FLARE NOTCH RADIATOR WITH SEPARATE TRANSMIT AND RECEIVE PORTS

This is a continuation of application Ser. No. 07/589,965 filed Sep. 28, 1990 now abandoned.

BACKGROUND OF THE INVENTION

The present invention relates to radiator elements of the type used in radar systems such as active array and phased radar applications.

The principle radiating elements heretofore used for broadband active arrays have been the dielectric bilateral and all metalized flared notch radiators. These radiators are described in, e.g., "Broadband Antenna Study," L. R. Lewis and J. Pozgay, Final Report AFCRL-TR-75-0178, Air Force Cambridge Research Laboratories, March 1975; "Analysis of the Tapered Slot Antenna," R. Janaswamy and D. Schaubert, IEEE Trans. Antennas and Propagation, Vol. AP-35, No. 9, September 1987, pages 1058–1059; "The Vivaldi Aerial," P. J. Gibson, Proceedings of the Ninth European Microwave Conference, 1979, at pages 101–105. Because of the coplanar nature of their slotline-type configuration, both of these radiators require balun transitions from stripline-type transmission line to the slotline flare notch in order to launch the RF signal from the stripline or microstrip mode to the slotline mode. The need for baluns tends to limit very wide band performance. The presence of the balun also tends to make the packaging more complicated and more costly.

Prior approaches to integrating a circulator or any other component to such radiator elements would be to first connect the component to the stripline portion of the balun which then transitions to the flared notch. This connection is either a direct connection or with the addition of some type of coaxial connector interface, with the attendant disadvantages that the structure is more difficult to assemble and with the possible degradation of the match.

The antipodal flared notch radiator, described in "Improved design of the Vivaldi antenna," by E. Gazit, IEE Proc., Vol. 135, Pt.H, No. 2, April 1988, at pages 89–92, extends the concept of the Van Heuven microstrip to waveguide transition to antenna elements. The Van Heuven transition is described, e.g., in "A New Model for Broadband Waveguide-to-Microstrip Transition Design," G. E. Ponchak and Alan N. Downey, Microwave Journal, May, 1988, pages 333 et seq. FIG. 1 shows a top view of the antipodal flared notch radiator 20. FIGS. 2A–2F illustrate particular cross-sectional views of the radiator device of FIG. 1. The input microstrip line 22 is transformed into a broadside coupled strip 24 (odd mode needed only) by narrowing the groundplane. The broadside coupled strips 24 then are transformed into an antipodal slotline 26. Finally the antipodal slotline flares out as in the typical notch radiator. Note how the electric fields of the microstrip 22 are rotated and transformed into the electric fields of the slotline (FIGS. 2A–2F). Thus, FIG. 2A illustrates the field configuration of the input microstripline. FIG. 2B shows the transitioning of the microstripline to the broadside-coupled strips (FIG. 2C). FIG. 2D shows the field configuration at the antipodal slotline. FIG. 2E shows the transitioning from the antipodal slotline to the flared out structure near the radiator tip (FIG. 2F).

FIGS. 3A–3F show various slotline structures and the corresponding gaps G. FIG. 3A shows a conventional coplanar slotline structure. FIG. 3B shows a sandwiched coplanar slotline, i.e., where the conductor strip and groundplane are sandwiched between dielectric layers. FIG. 3C shows a coplanar thick metal slotline structure. FIG. 3D shows a bilateral coplanar slotline structure. FIG. 3E shows an antipodal slotline structure. FIG. 3F shows a sandwiched antipodal slotline structure.

The antipodal structure is more versatile than conventional coplanar or bilateral slotline structures because low impedances (characteristic impedance Z less than 60 ohms) can be realized more easily. Low impedances in conventional coplanar and bilateral slotlines require very narrow slot gap dimensions which are difficult to realize because of manufacturing tolerances. Low impedance in antipodal slotline are relatively easy to realize because it involves simply controlling the amount of overlap between the two conductors.

As shown in FIG. 1, there are no abrupt transitions or discontinuities to limit the bandwidth performance of the antipodal flared notch radiator element. All the transmission lines can be designed to be 50 ohms prior to entry into the flared region. Since there is no balun required, fabrication of this element is very simple and inexpensive because it involves only a single double-sided printed circuit board. One limitation of the conventional antipodal flared notch radiator is that the opening of the flared notch is a half-wavelength at the low end of the frequency band. As the low end of the frequency band is decreased, the physical size of the flared notch increases and may exceed the allowable physical space for some applications. Another limitation is that the conventional radiator has only a single port (microstripline 22) which must be used for both transmit and receive operations.

Because of its asymmetry, the antipodal flare notch radiator of FIG. 1 would be difficult to model analytically in an array, and will not image properly in waveguide simulators. Waveguide simulators, as is well known in the art, are test apparatus used to measure the active impedance of large or infinite arrays. Small clusters of radiating elements are placed in a waveguide, which acts as a mirror, simulating the performance of an infinite array. To work properly, the small cluster must be symmetric with respect to the walls of the waveguide.

Accordingly it is an object of this invention to provide a flared notch radiator element with separate transmit and receive ports.

SUMMARY OF THE INVENTION

The device is a dielectric flared notch radiator with separate transmit and receive ports for phased array and active array antennas. This is achieved by integrating a drop-in microstrip or stripline circulator directly to the broadside-coupled-strip transmission line portion of a dielectric antipodal flared notch radiator. This integration is by direct connection to the flared notch between two additional layers of dielectric, and thus the device can be made an applicable building block for broadband active array antennas.

The device can be made to operate over a very wide frequency band. Integrating the circulator with the radiator improves the "look in" active impedance of the array by isolating the aperture for the various mismatches behind the circulator of each dielectric flared notch raditor. "Look in" active impedance is also improved because the discontinuities normally associated with a balun will not be present.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 is an exploded perspective view of a radiator element embodying the invention.

FIG. 5 is a schematic diagram of the device of FIG. 4.

FIG. 6 is a schematic diagram of an array of elements.

DETAILED DESCRIPTION OF THE PREFERRED EMBODIMENT

The invention is a modified antipodal flared notch radiator with separate transmit and receive ports for phased array and active array antenna applications. The device uses a new approach for connecting a microstrip circulator directly into the flared notch radiator without the use of a conventional balun.

Figure 1:
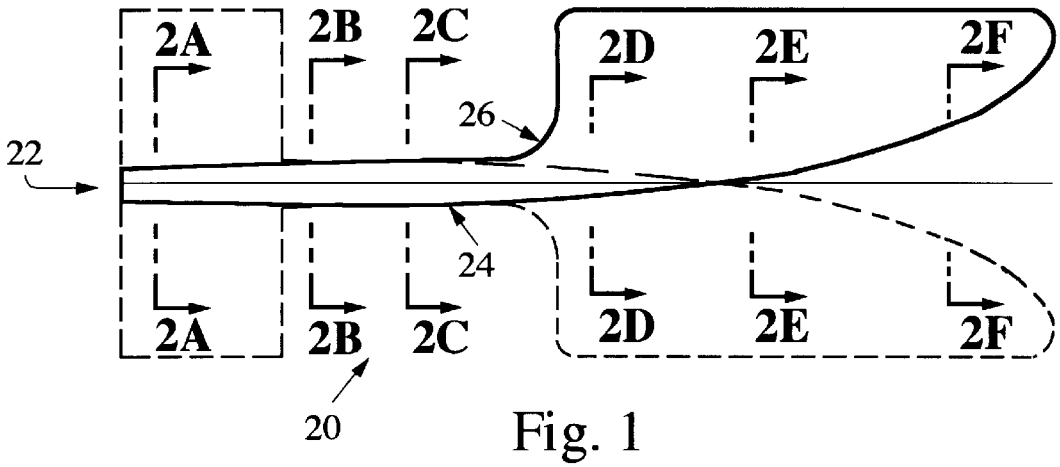
Fig. 1 ( Prior Art )
FIGS. 1 and 2A–2F illustrate a known antipodal flared notch radiator element.
Figure 2A:
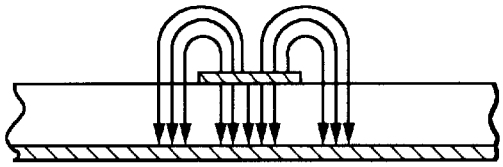
Fig. 2A ( Prior Art )
Figure 2B:
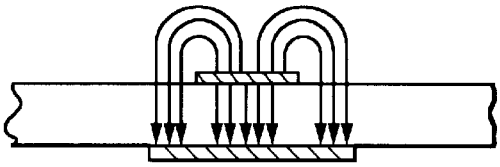
Fig. 2B ( Prior Art )
Figure 2C:
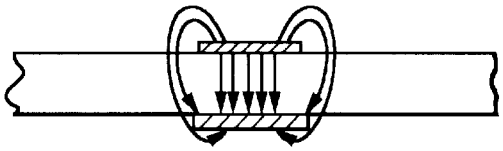
Fig. 2C ( Prior Art )
Figure 2D:
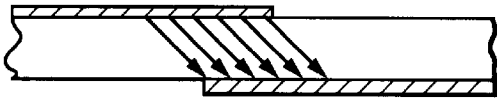
Fig. 2D ( Prior Art )
Figure 2E:
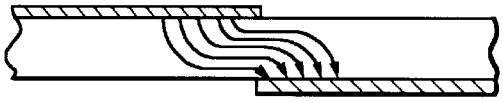
Fig. 2E ( Prior Art )
Figure 2F:
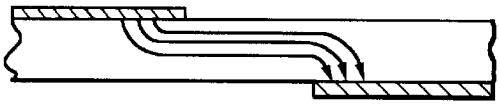
Fig. 2F ( Prior Art )
Figure 3A:
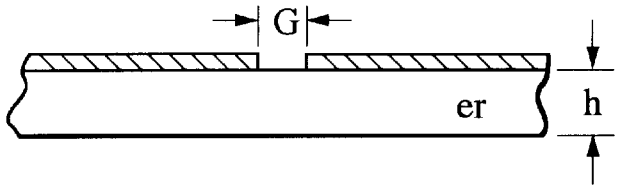
Fig. 3A ( Prior Art )
FIGS. 3A–F illustrate several slotline transmission line structures.
Figure 3B:
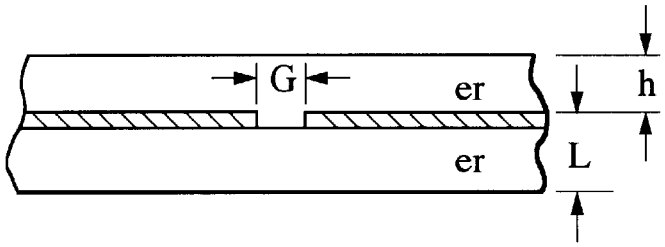
Fig. 3B ( Prior Art )
Figure 3C:
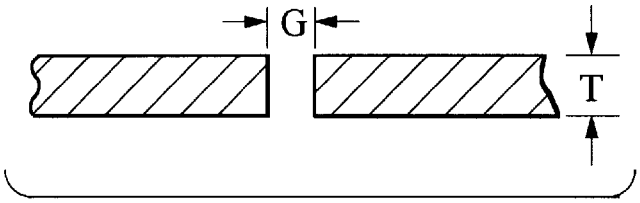
Fig. 3C ( Prior Art )
Figure 3D:
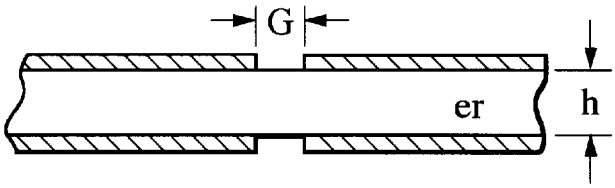
Fig. 3D ( Prior Art )
Figure 3E:
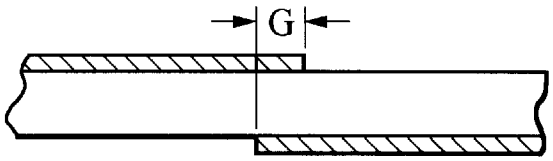
Fig. 3E ( Prior Art )
Figure 3F:
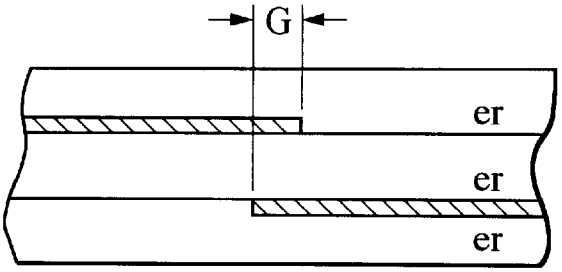
Fig. 3F ( Prior Art )

An exploded perspective view of a preferred embodiment of the invention is shown in FIG. 4. The radiator 50 is made applicable in an array environment by sandwiching the flared notch region 52 between two layers 54 and 56 of dielectric material in the manner illustrated in FIG. 3F.

The radiator 50 comprises a center dielectric board 58 having first and second planar surfaces 60 and 62. A conductive pattern is formed on each surface, to define the antipodal flared notch configuration of the radiating element 50. Thus, the conductive pattern 66 is formed on the upper surface 60, and the conductive pattern 64 is formed on the lower surface 62. Pattern 66 includes microstripline conductor 70 which is terminated in a coaxial connector 72, used in this embodiment for receive operation. Pattern 66 further includes microstripline conductor 74 which terminates in a coaxial connector 76, used in this embodiment for transmit operation. The pattern 64 includes a conductive ground plane region 55 which underlays the microstripline conductors of the pattern 66. This ground plane region 55 transitions to a strip conductor region underlying the strip region 78 of the pattern 66.

The microstripline conductors 70 and 74 are brought adjacent each other at a region where the circulator 80 is connected, as is more fully described below with respect to FIG. 5. Thereafter the respective conductor strips of the upper and lower patterns 66 and 64 define broadside coupled strips, of which only strip 78 is visible in FIG. 4. The broadside coupled strips then transition to the flared conductive regions 84 and 86 which together define the antipodal slotline of the radiator 50.

The layers 54 and 56 are preferably fabricated from the same dielectric material as the center dielectric board 58 of the radiator 50, e.g., woven fiberglass PTFE, and force the radiating element to operate like a coplanar slotline-type of structure, by concentrating the fields. It is not necessary, in the practice of the invention, to use the boards 54 and 56, but their use makes it easier to design the element for some applications and to analytically model the structure in a large array.

As is well known in the art, an array is a cluster of elements laid out in an orderly lattice, and the lattice spacing is one distance between adjacent elements. FIG. 6 illustrates an array 100 comprising radiating elements 102–106; the lattice spacing d is the distance between adjacent elements. Each of the radiating elements 102–106 can be radiator 50 as illustrated in FIGS. 4 and 5. By imposing the condition that the center dielectric board 58 between the two conductor patterns 64 and 66 is sufficiently thin compared to the array lattice spacing, the embedded antipodal slotline will closely approximate embedded coplanar slotline which is a structure that can be modeled mathematically in an array environment. For example, given a lattice spacing of 0.5 inch, "sufficiently thin" would be 20% of 0.5 inch or less. The center broad thickness would be less, e.g., 50 mils. Likewise, waveguide simulators with this embedded flared notch can be built to closely simulate the array environment for various H-plane scan angles across the band of interest.

The construction of this antipodal flared notch radiator element has been configured so that all components are attached to the outside of the notch printed circuit board 58. This allows for easy installation of a microstrip circulator or any packaged "drop-in" component. The circulator 80 is connected to the coupled strip region of the flared notch, or closer to the antipodal slotline as need be. Miniature drop-in circulators suitable for the purpose of circulator 80 are commercially available. For example, Teledyne Microwave, 1290 Terra Bella Avenue, Mountain View, Calif. 94043, markets exemplary devices as model nos. C-*M13U-$^{xx}$, C-*M13U-$^{xx}$ and C-8M43U-10.

Other microwave devices may be used in place of the circulator 80. For example, PIN diode switches may be used to alternatively connect either the transmit or receive port to the radiating element. Of course, the device would then not be capable of simultaneous transmit and receive operation, and active circuitry would be required to operate the PIN diodes.

FIG. 5 shows a simplified schematic representation of the radiating element 50. The circulator 80 has three ports 80*a*, 80*b*, 80*c*. Port 80*a* is connected to microstripline conductor 74, port 80*b* is connected to microstripline conductor 70 and port 80*c* is connected to strip conductor 78. The element 50 defines a broadside coupled strip region 88, which transitions to the sandwiched antipodal slotline 90 defined by the flared portions of the conductor patterns 66 and 64. It will be apparent that by operation of the circulator 80, energy incident on port 80*b* from the transmit port 76 will be coupled to the broadside coupled strip region 88 to be radiated out of the element 50. Energy received by the element 50 will be conducted to port 80*c* of the circulator 80 via the slotline region and the broadside coupled strip region 88, and will be coupled to the port 80*a* and via microstripline 70 to the receive port 72. The circulator 80 provides isolation between the receive and transmit ports.

As an isolated element, a prototype radiating element had a VSWR of 1.9:1 across a 7 GHz to 26.5 GHz bandwidth. The performance would be only limited by the performance of the circulator. Across the circulator operating bandwidth, the radiator circulator combination improves the VSWR by isolating the flared notch from mismatches from behind the circulator such as load and connector mismatches at the transmit and receive ports. Finally the active impedance become less sensitive to load variations from components behind the circulator at its transmit and receive ports such as transmit/receive modules, phase shifters, and feeds.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An integrated antipodal flared notch radiating element for radiating energy into, or receiving energy from free space and having separate, integral transmit and receive ports, said element suitable for a large active array characterized by an element lattice spacing, the integrated antipodal flared notch radiating element comprising:

a planar dielectric board having first and second opposed surfaces, the first surface having a first conductive pattern formed thereon, the second surface having a second conductive pattern formed thereon;

wherein said first and second conductive patterns cooperate to define an antipodal slotline adjacent a flared end thereof and a broadside coupled strip transmission line region which transitions into said antipodal slotline, said broadside coupled strip transmission line region formed by first and second conductive strips overlying each other on opposite sides of the dielectric board;

said first conductive pattern further defining first and second microstripline conductors formed on said first board surface adjacent a receive/transmit port end of said radiating element, said first microstripline conductor connecting to a transmit port integrated with said radiating element, said second microstripline conductor connecting to a receive port integrated with said radiating element;

said second conductive pattern further defining a ground plane region adjacent said port end of said radiating element underlying said microstripline conductors, said ground plane region transitioning to said second conductive strip comprising said broadside coupled strip region;

a circulator device integrated with said broadside coupled strip transmission line region such that the circulator device is mounted on said dielectric board and includes a terminal connected to one of said conductive strips comprising said broadside coupled strip transmission line region, said circulator device having a first terminal connected to said first microstripline conductor, a second terminal connected to said first conductor strip comprising said broadside coupled strip region, and a third terminal connected to said second microstripline conductor, wherein said broadside coupled strip transmission line region is coupled to said first and second microstripline conductors without a balun; and first and second dielectric sheets disposed to sandwich said flared end of said element and force said antipodal slotline of said radiating element to operate as a coplanar slotline-type of structure by concentrating fields.

2. The radiating element of claim 1 further comprising first and second coaxial connectors connected respectively to said first and second microstripline conductors secured to said dielectric board.

3. The radiating element of claim 1 wherein said ground plane region is essentially a rectangular configuration extending from said port end to said broadside coupled strip transmission line region.

4. An integrated antipodal flared notch radiating element for radiating energy into, or receiving energy from, free space, said radiating element having separate, integral transmit and receive connections which are isolated from each other, said integrated antipodal flared notch radiating element comprising:

a planar dielectric board having first and second opposed surfaces, the first surface having a first conductive pattern formed thereon, the second surface having a second conductive pattern formed thereon;

wherein said first and second conductive patterns cooperate to define an antipodal slotline adjacent a flared end thereof and a broadside coupled strip transmission line region which transitions into said antipodal slotline, said broadside coupled strip transmission line region formed by first and second conductive strips overlying each other on opposite sides of the dielectric board;

said first conductive pattern further defining first and second microstripline conductors adjacent a receive/transmit port end of said radiating element, said first microstripline conductor comprising a transmit signal connection integrated with said radiating element, said second microstripline conductor comprising a receive signal connection integrated with said radiating element;

said second conductive pattern further defining a ground plane region adjacent said transmit/receive port end of said element and underlying said microstripline conductors, said ground plane region transitioning to said second conductive strip comprising said broadside coupled strip transmission line region; and a circulator device integrated with said broadside coupled strip transmission line region such that the circulator device is mounted on said dielectric board and includes a terminal connected to one of said conductive strips comprising said broadside coupled strip transmission line region, said circulator device connecting said broadside coupled strip transmission line region to said first microstripline conductor without a balun, and connecting said broadside coupled strip transmission line region to said second microstripline conductor without a balun, said circulator device electrically isolating said first microstripline conductor from said second microstripline conductor at microwave frequencies, said circulator device including a first terminal connected to said first microstripline conductor, a second terminal connected to said first conductive strip comprising said broadside coupled strip transmission line region, and a third terminal connected to said second microstripline conductor.

5. The radiating element of claim 4 further comprising first and second dielectric sheets disposed to sandwich said dielectric board, said first and second sheets having respective thicknesses which concentrate electric fields and force said antipodal slotline of said radiating element to operate as a coplanar slotline type of structure.

6. The radiating element of claim 5 further characterized in that said element is used in a large array of radiating elements, wherein adjacent elements are separated by a lattice spacing in a given dimension, and wherein the thickness of said dielectric sheets is 20% or less of said lattice spacing.

7. The radiating element of claim 4 further comprising first and second coaxial connectors connected respectively to said first and second microstripline conductors and secured to said dielectric board.

8. The radiating element of claim 4 wherein said ground plane region is essentially a rectangular configuration extending from said port end to said broadside coupled strip transmission line region.

* * * * *